United States Patent [19]

Renaud

[11] Patent Number: 4,513,991

[45] Date of Patent: Apr. 30, 1985

[54] CONVERTIBLE DESIGN SURFACE, AND METHOD FOR FORMING THE DESIGN

[76] Inventor: Bruce J. Renaud, 1443 Seminole Ave., Detroit, Mich. 48214

[21] Appl. No.: 399,137

[22] Filed: Jul. 16, 1982

[51] Int. Cl.[3] ..... B42D 15/00

[52] U.S. Cl. ..... 283/1 R; 234/1; 283/75; 51/310; 346/1.1; 346/135.1

[58] Field of Search ..... 283/1 R, 75, 1 A; 51/310, 311, 312; 428/76, 54; 346/1.1, 135.1; 234/1

[56] References Cited

U.S. PATENT DOCUMENTS

| | | | |
|---|---|---|---|
| 1,448,286 | 3/1923 | Comstock . | |
| 1,576,156 | 3/1926 | Swoboda . | |
| 2,277,937 | 3/1942 | Shryer | 51/310 |
| 2,925,625 | 2/1960 | Souza . | |
| 3,047,443 | 7/1962 | Anderson | 154/56 |
| 3,852,145 | 12/1974 | Kloweit . | |
| 3,856,610 | 12/1974 | Bruneel | 428/76 |
| 4,097,895 | 6/1978 | Spong | 346/135.1 X |
| 4,198,774 | 4/1980 | Roberts et al. | 40/587 |
| 4,272,612 | 6/1981 | Oliver | 51/310 X |
| 4,290,075 | 9/1981 | Jocobs et al. | 346/135.1 X |
| 4,395,718 | 7/1983 | Murayama et al. | 346/135.1 |
| 4,408,365 | 10/1983 | Palmer | 428/54 X |
| 4,427,985 | 1/1984 | Kikuchi et al. | 346/1.1 X |

*Primary Examiner*—Paul A. Bell

*Attorney, Agent, or Firm*—Burton, Parker & Schramm

[57] ABSTRACT

Each projection, in a field of projections, on the surface of an article, may be selectively removed to form an indicium or indicia in the field. The projections may have a cover of one color and a core of another, so that by selective removal of the each projection, the indicium appears in a field of different color. The projections may be made from a variety of materials including molded rubber, metal plated plastic, textiles. The core of each projection may include more than one stratum, with each stratum having the potential to be a different color. Thus multi-colored indicia may be formed.

19 Claims, 24 Drawing Figures

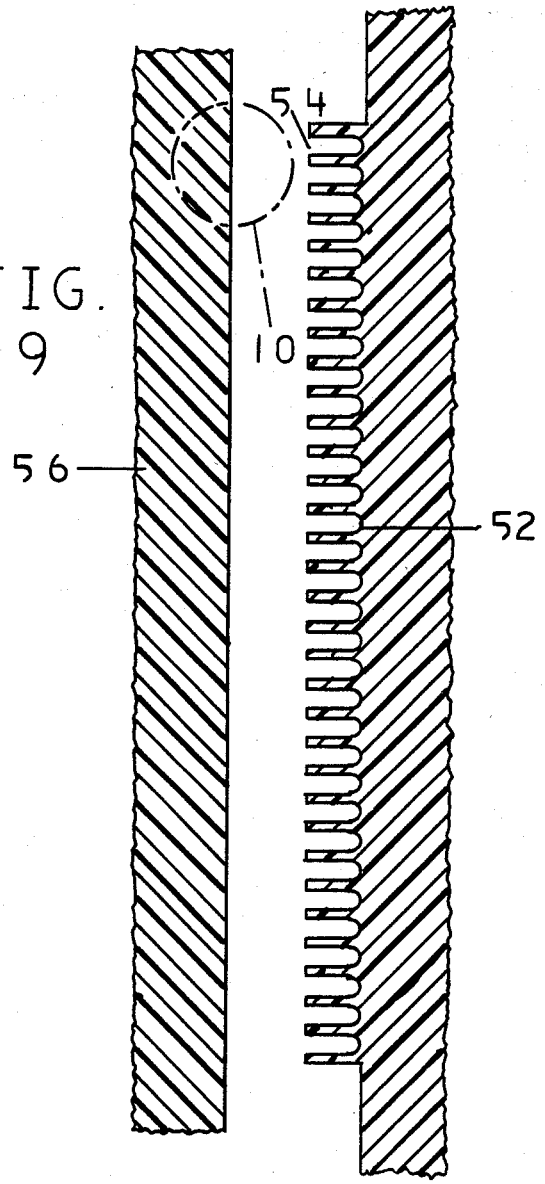
FIG. 9
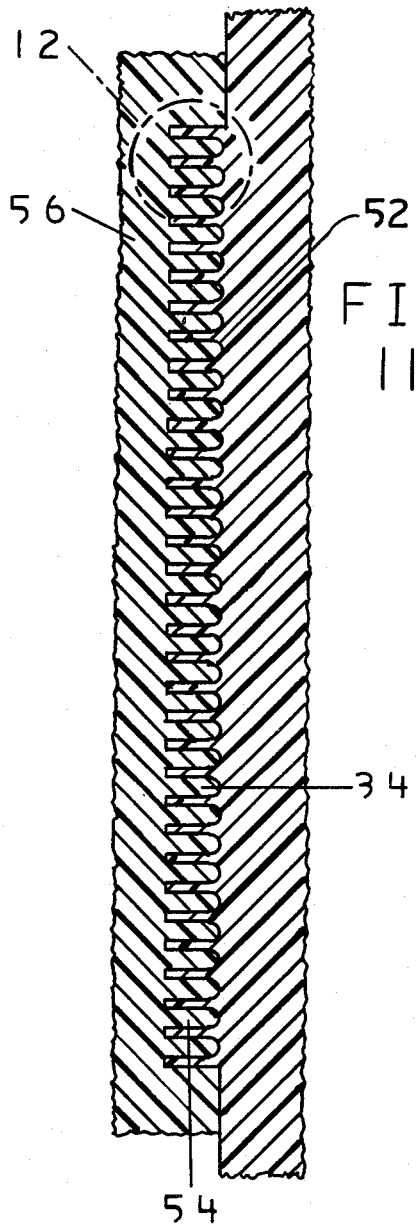
FIG. 11
FIG. 10
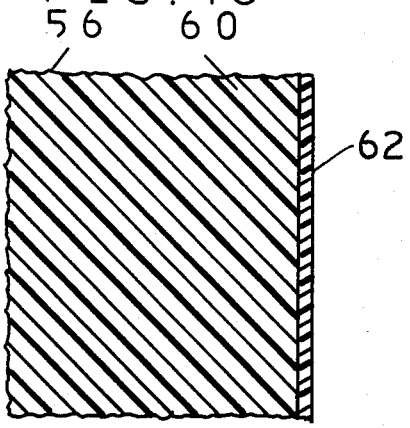
FIG. 12
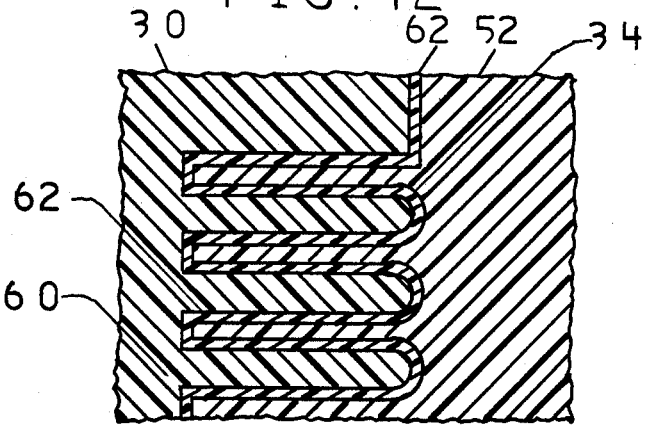

CONVERTIBLE DESIGN SURFACE, AND METHOD FOR FORMING THE DESIGN

DESCRIPTION

1. Field of the Invention

This invention relates to an article in which an integral design may be formed, and includes the article containing the design and the method for making the design. The article includes a field of projections on its surface, into which field an indicium is, or may be incorporated by the selective reduction or removal of projections.

2. Background of the Invention

Since time immemorial, man has attempted to place indicia of one form or another onto his possessions. Initials, names, and other designs, have been carved or burned into wood, chiseled in stone, and painted on numerous surfaces. Generally, these techniques required individual creative effort and labor for each product made.

When goods are mass produced such personalization becomes impractical, as it was individual effort that made personalization possible. In the tire industry, for example, names, logos and other designs have been imprinted on tires and rubber products using molds. Such molds allow the creation of a large number of imprints via machine production. However, such molds do not, on a practical basis, allow for individual personalization of the tires as with a person's name or other special design, as separate molds have to be made and used for each name or design.

SUMMARY OF THE INVENTION

Consequently, I have conceived an approach to the mass production of articles which provides the consumer the opportunity to personalize each mass produced article, by forming a design or other indicium thereon. My invention includes an article having a surface containing a grid like field of closely arranged discrete projections, with each projection in the field being selectively removable for forming design or indicium in the field. The projections preferably include a core of one or more colors contrasting with the exterior color of the projections so that the selective removal of projections exposes the color of the core and collectively creates indicium or designs of one or more colors in the field of projections.

The article is preferably made by molding an elastomeric or plastic laminate having differently colored lamina. However, other methods can be used for other materials, such as metal coated plastics or coated fibers.

Generally, an indicium is incorporated into the field of projections on the article by selecting the projections in the field which need to be removed in order to form an indicium, and removing those selected projections. The term "removal" is intended to include the removal of all or a portion of a projection.

With some embodiments of the invention such as elastomeric articles, the projections are easily removed, and nail clippers, scissors and other simple tools may be used. The ease of removal of the projections allows individuals to personalize their articles, or otherwise encode them, as a theft deterrent or as a means for identifying and retrieving the article after it has been stolen.

The ease of adding identification to the finished product permits manufacturer's to first inspect, measure, and grade the quality for the various aspects of appearance and performance capability of an article, and subsequently place the appropriate grademark, quality indicator, trademark, or brand name on that article. This "post manufacturing" classification and identification permits the most efficient usage and distribution in the marketplace, as there is a normal variation in the characteristics a product may have. For example, with tire dealers, those in hot climates with high speed drivers might need a product with maximum safety features; those in hill country might desire long mileage durability; those in affluent societies, having large cars might prefer a comfortable ride; while those selling to segments of the market desiring only low price and basic transportation might desire other characteristics. This method may even avoid discarding products having a few limiting characteristics.

The invention may be embodied in the manufacturer's product, such as a tire. Or the embodiment of the invention may be a separate article which can be attached to the product, much in the manner of a name tag, by gluing, stapling, taping, riveting, and the like.

Additionally, the fact that the indicium is formed by removing projections which were molded in a precise manner, such as in straight rows and columns, helps to assure precision in the design being formed.

BRIEF DESCRIPTION OF THE DRAWINGS

FIG. 9 is a fragmentary sectional view of a matlike article prior to being molded and the mold used;

FIG. 10 is an enlarged fragmentary, sectional view of the mat, before molding, as represented by the broken line circle, 10, of FIG. 9;

FIG. 11 is a fragmentary, sectional view of the mat and mold;

FIG. 12 is an enlarged, fragmentary, sectional view of the mat of FIG. 11 and the mold portion as indicated by the broken-line circle, 12, of FIG. 11;

A DESCRIPTION OF THE PREFERRED EMBODIMENTS

Figure 1:
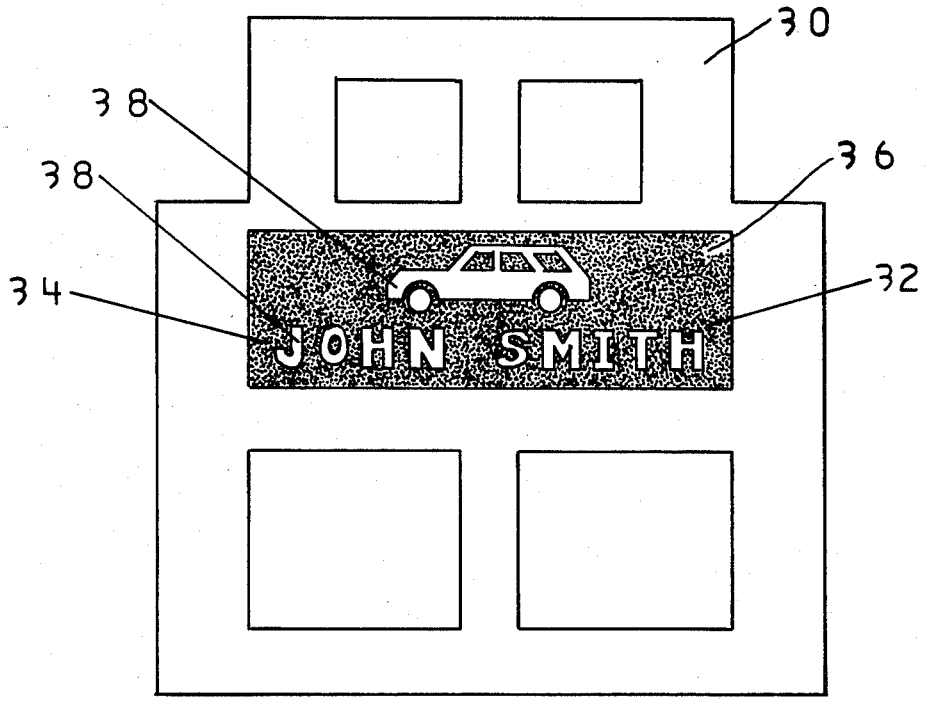
FIG. 1 is a plan view of an automobile floor mat constructed in accordance with this invention, depicting a design or an indicium formed by the removal of projections.

The embodiment of the invention of FIG. 1 includes an automobile floor mat 30, having an area 32 in which surface closely arranged discrete projections 34 form a grid-like field 36 within the area 32. The field has indicia 38 incorporated therein in the likeness of objects such as an automobile and in the likeness of names such as "John Smith". The indicia are formed by the selective removal of portions of the projections 34 in the field 36.

Figures 3, 4:
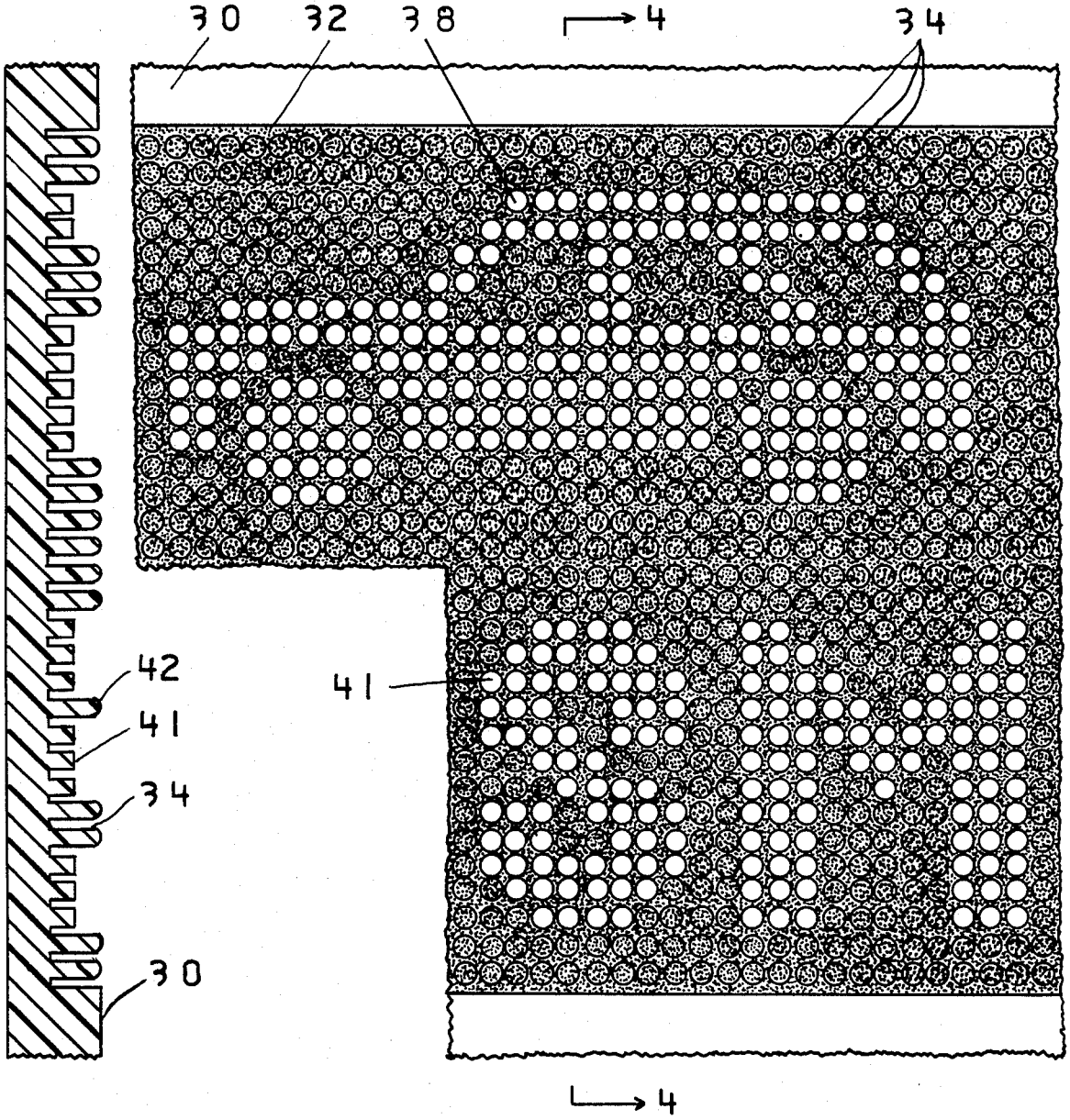
FIG. 3 is a fragmentary, enlarged plan view of a portion of the design of FIG. 1.
FIG. 4 is a fragmentary, sectional view of FIG. 3, taken along line 4—4 of FIG. 3.

FIG. 3, the enlarged view of FIG. 1, provides a better view of each individual projection 34 and the stubble 41 formed by the removal of projections 34. As shown in FIG. 4, the projections 34 are preferably of substantially equal size, with the stubble 41 being shorter. The indicium 38 is formed in part by this contrast.

Figure 5:
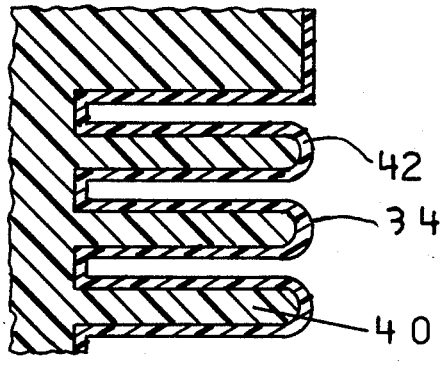
FIG. 5 is an enlarged, fragmentary sectional view of a portion of FIG. 4.
Figure 6:
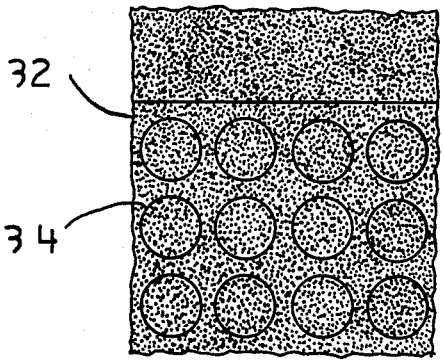
FIG. 6 is an enlarged, fragmentary plan view corresponding to the sectional view of FIG. 5.
Figure 7:
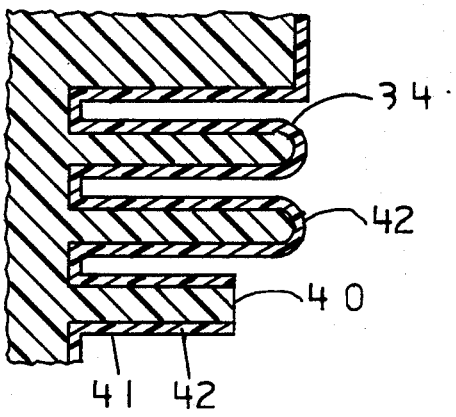
FIG. 7 is an enlarged, fragmentary sectional view corresponding to the sectional view of FIG. 5, after projection has been reduced.
Figure 8:
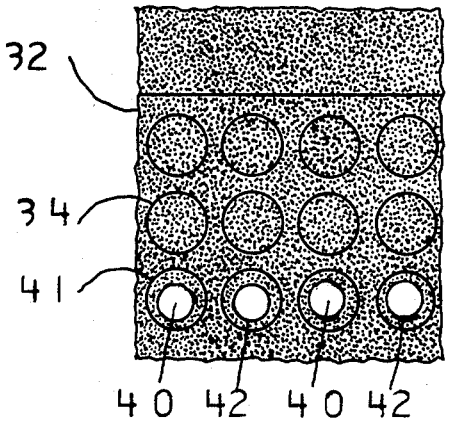
FIG. 8 is an enlarged, fragmentary plan view corresponding to the view of FIG. 7, after portions of certain projections have been reduced.

A color contrast between the indicium 38 and the field 36 generally, may occur by merely coating the stubble 41 with a color that contrasts with the projections 34 of the field 36. However, it is preferred, as shown in FIG. 5, that the projections 34 have a core 40, with a covering 42. And preferably the core 40 should be of one color and the cover 42 of another color. Prior to the removal of selected projections 34, all the projection will seem to be the color of the cover 42 as in FIG. 6. Thus, the removal of a projection 34, as in FIG. 7, removes a corresponding portion of the cover 42 to expose the differently colored core 40. As shown in FIG. 8, this differently colored core 40, exposed to view on the stubble 41 remaining after the removal of a projection 34, stands in stark contrast to the coloring of the cover 42.

Moreover, in the preferred embodiment, the cover 42 will cover the entire area 32 as well as each projection 34, in the area, so that the covering 42 on the stubble 41 will blend in with the area 32 as well as with the other projections 34. Thus, the incorporation of the indicium 38 into the field 36 is facilitated by the color contrast between the core 40 and the cover 42.

Generally the height of the projections 34 and the packing density of the projections 34 in the field 36 will be dictated by the need to form an indicium 38 which is readily discernable, as well as by the technique used in removing the projections. The more closely packed the projections 34, the less likely the individual projections 34 or stubble 41 will be noticed. The observance of the indicia 38 will be facilitated by the normal tendency of the human mind to abstract concepts, or, in this case, the indicium 38. Therefore, in many cases the individual stubble 41 and the individual projections 34 will not be noticed. For example, the automotive floor mat of FIG. 1 has an area 32 in which an indicium 38 has been incorporated into a field 36 of projections 34. Although the indicium 38 is clearly discernable, the individual stubble is not. As best shown in FIGS. 7 and 8, in this instance, the core 40 is of a white elastomeric material and the cover 42 is of a black elastomeric material. The indicium 38 is formed by the stubble 41 which reveals the white colored core 40 which is bordered by the field of black cover 42 on projections 36.

Figure 2:
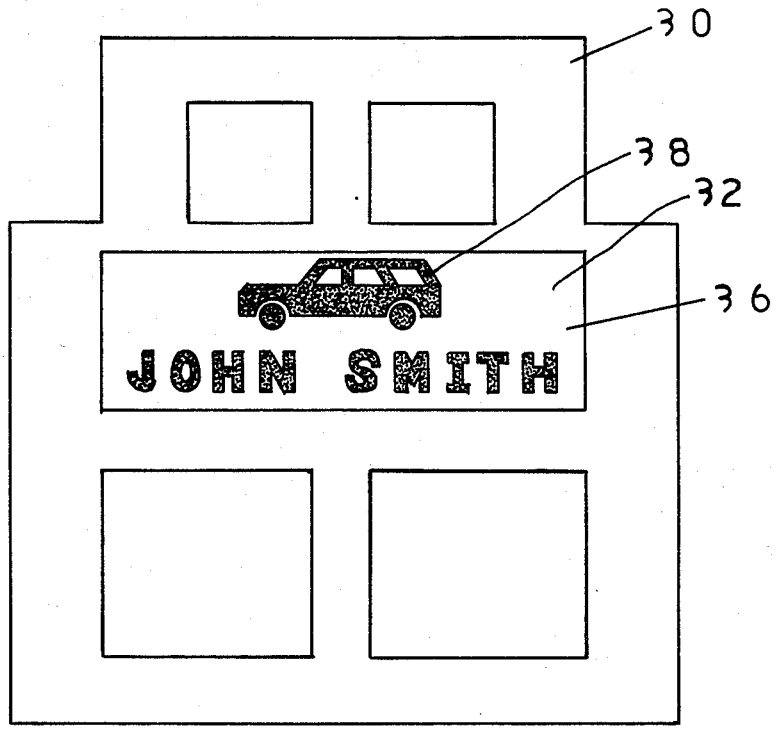
FIG. 2 is a plan view of another embodiment of the invention on a mat having indicia formed in accordance with the invention.

FIG. 2 depicts a similar mat in which stubble 41, as shown in FIGS. 7 and 8, having a white core 40 form the field 36, while the projections 34 having a black cover 42 constitute the indicium 38. Thus, there is some latitude afforded by this two color system in determining the color of the indicium 38, and naturally the core and cover may be of any known or available color.

Generally, the more closely spaced the projections are, the more vivid and precise the indicium 38 will be in contrast to the field 36. The same contrast and appearance of a crisp, vivid indicium can be accomplished with increasingly greater spacing between the projections 34 if the distance between the indicium and the viewer also increases.

Although it is preferred that the projections 34 be as close together as possible, from the point of view of picture clarity it is prefered to leave sufficient space between the projections to allow each individual projection to be cut with a nail clipper or scissors. With articles that can be flexed, the mere flexing of the article allows greater access to each projection, thus allowing closer spacing of the projections. Of course, abrading devices or cutting devices may be used which may cut the projections without singling out each projection. However, it is preferred that the projections be spaced far enough apart to be individually removed.

As an example, an automobile tire having projections 34 with a 0.058 inch diameter base and a height of 0.125 inch can reasonably have a spacing of 0.016 inch between projections 34.

It is possible to provide different cores having different colors or color combinations so that the indicium may be multi-colored.

Figure 13:
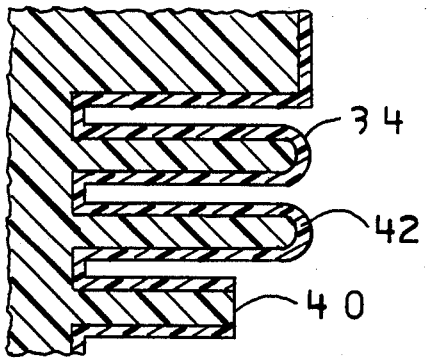
FIG. 13 is an enlarged, fragmentary sectional view of an embodiment of the invention in which the cover of the projection is one color while the core of the projection is of a second color in one area of the article and a third color in another area of the article.
Figure 14:
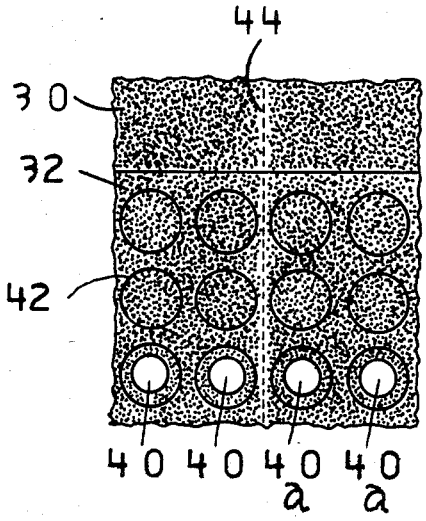
FIG. 14 is an enlarged, fragmentary plan view of an embodiment of the invention corresponding to the sectional view of FIG. 13.

One such embodiment is shown in FIG. 14 in which article 30 has an area 32 formed in which there is a dividing line 44 on one side of which the core 40 is of one color, while on the other side the core 40A is a different color. As shown in FIG. 13, each projection 34 has only one core 40 and one cover 42, with each core preferably being a single color.

Figure 15:
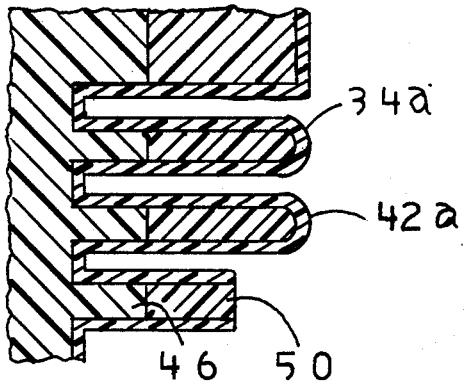
FIG. 15 is an enlarged, fragmentary sectional view of an embodiment of the invention in which the projection includes a cover and two strata, each of different colors.

However, each core 40 may be composed of stratum having different colors. In FIG. 15 each projection 34*a* has a core which includes a first stratum 46 and a second stratum 50 contiguous to the first stratum 46.

Figure 16:
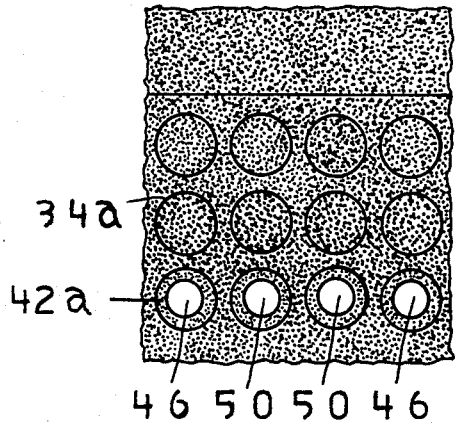
FIG. 16 is an enlarged, fragmentary plan view corresponding to the sectional view of FIG. 15.

As shown in FIGS. 15 and 16, if only a part of the second stratum 50 is removed, then the color of the second stratum 50 will be exposed. However, if the entire second stratum 50 is removed, then the color of the first stratum 46 will be exposed. In this manner the color of the indicium 38 may include the color of the first stratum 46, the color of the second stratum 50, or a combination of both colors.

Although all of the embodiments of the invention discussed so far have been made of elastomeric or plastic materials, articles of the invention may be formed from other materials.

Figure 17:
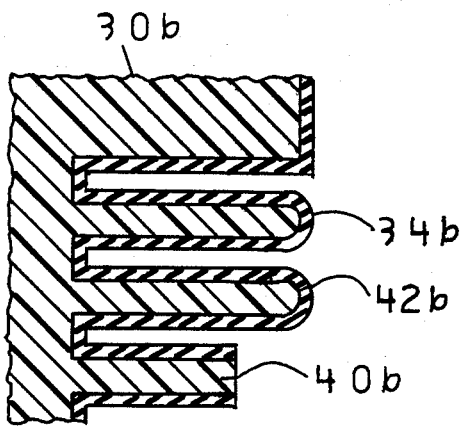
FIG. 17 is an enlarged, fragmentary sectional view of an embodiment depicting a metallized cover for the projection and a plastic core.
Figure 18:
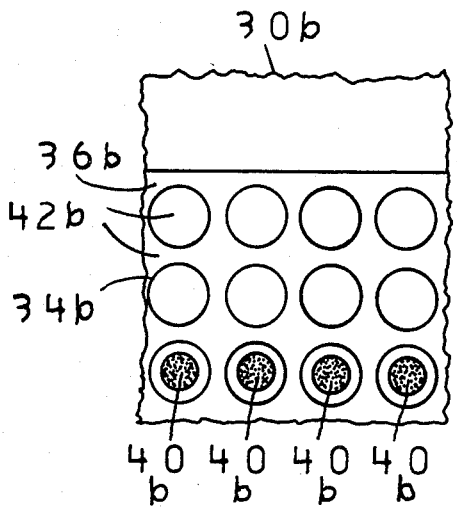
FIG. 18 is an enlarged, fragmentary plan view of the embodiment of FIG. 17.

In FIG. 17 and its corresponding FIG. 18 for example, the article 30*b* has a field 36 of projections 34*b* in which each projection has a plastic core 40*b* and a metallized covering 42*b* where the term metallized covering includes coverings which are metallic or which are designed to appear metallic. Thus, the removal of a projection 34*b* exposes the plastic core 40*b*. Preferably, the core 40*b* and cover 42*b* will contrast so metallized or plastic indicium 38 may be formed.

Figure 19:
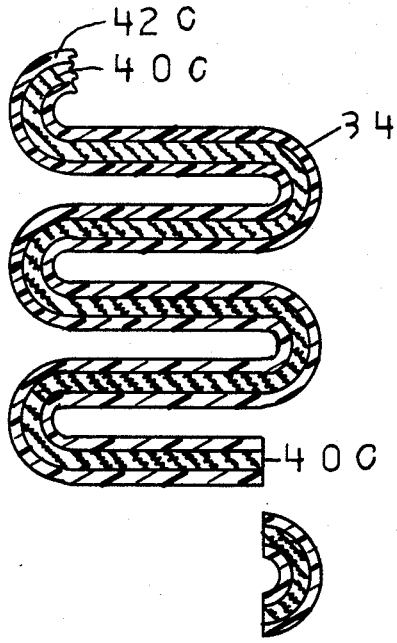
FIG. 19 is an enlarged, fragmentary sectional view of an embodiment having projections formed from a looped fiber or textile cord.
Figure 20:
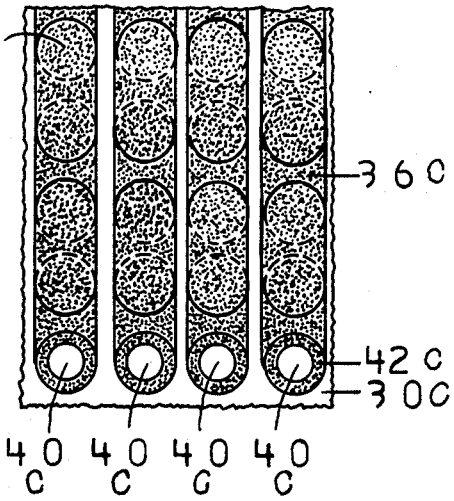
FIG. 20 is an enlarged, fragmentary plan view corresponding to the sectional view of FIG. 19.

FIGS. 19 and 20 depict an embodiment of the invention which includes a cord made into an article 30*c* to form projections 34*c* in a field 36*c*. The cord has a core 40*c* which is a strand or collection of strands of plastic, metallic or fibrous material with a covering 42*c* of a plastic, elastomeric or textile material. The removal of projections 34*c* exposes the core 40*a*, which preferably contrasts in color with the covering 42*c*, although the contrast in texture may be sufficient to form an adequate contrast between the indicium 38 and the rest of the field 36*c* where the core 40*c* is a woven fiber.

Figure 21:
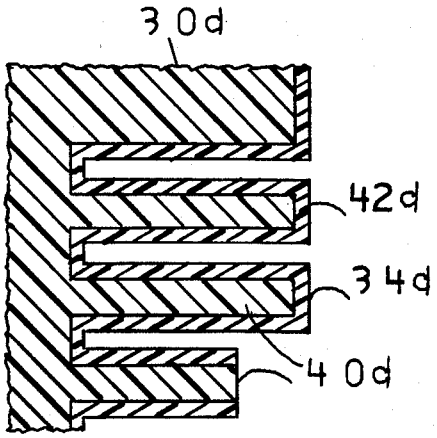
FIG. 21 is an enlarged, fragmentary sectional view of an embodiment having rectangular projections.
Figure 22:
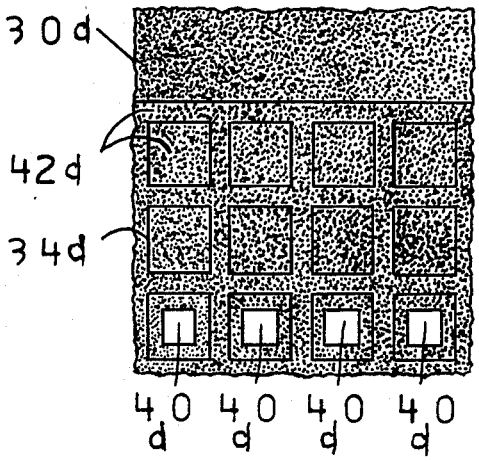
FIG. 22 is an enlarged fragmentary plan view corresponding to the sectional view of FIG. 21.

The shape of the projections 34 and the spacing of the projections 34 in the field may also vary. FIGS. 21 and 22 depict a rectangular projection 34*d*, while FIGS. 4, 5, 7, 13 15 and 17, depict rounded projections. FIGS. 21 and 22 depict projections which have a space between them, while FIGS. 23 through 24 indicate a projection with no apparent space between.

In practice most of the articles depicted were made from molding plastic or elastomeric material as shown in FIGS. 9 through 12.

In FIGS. 9 and 11 a mold 52 having indentations 54 is juxtaposed with an uncured sample 56 of plastic or elastomer. The sample 56 is then placed in the mold 52 as shown in FIG. 11, so that the indentations 54 effectively form the projections 34. Typically, the sample 56 is cured and removed from the mold the mold 52. More particularly, it can be seen in FIG. 10 that the sample 56 includes a body portion 60 and a lamination 62. Thus when the sample 56 is molded as shown in FIG. 12, an article 30 is formed having projections 34. Moreover, multiple strata can be formed by placing a second lamination (not shown) on the lamination 62 shown. A color zone can be formed by making the article in sections of different colors.

Metal coated plastics may be manufactured, as in FIG. 17 and FIG. 18, by forming the core 40 in a mold 52 as in FIGS. 9 through 12 and applying a metallized coating by electro-coating, spraying, dipping or other known methods. Also, the coating may be applied by placing it in the mold prior to insertion of the uncured sample 56.

Yarn, textile, wire or other material of FIGS. 19 and 20 may be covered by coating, dipping and spraying and the like with plastic or it may be slipped through a sheath of a plastic material, and then it may be woven into a mat as shown in FIG. 20.

Figure 23:
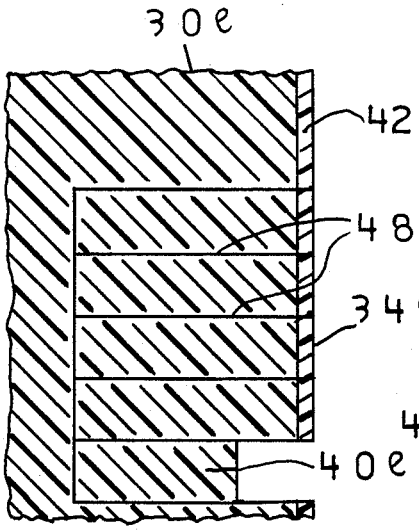
FIG. 23 is an enlarged, fragmentary sectional view of an embodiment having rectangular projections.
Figure 24:
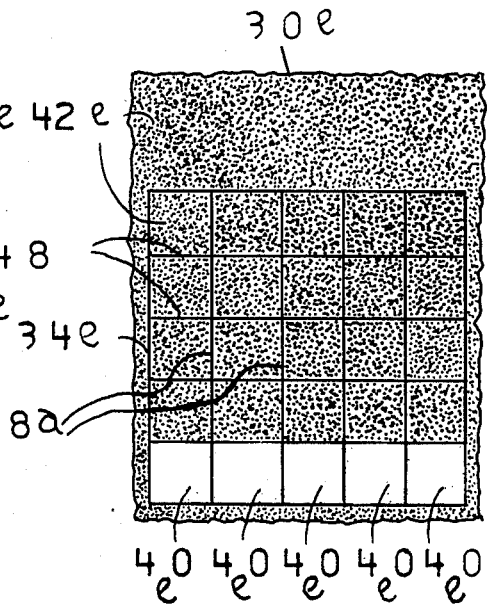
FIG. 24 is an enlarged, fragmentary plan view corresponding to the sectional view of FIG. 23 depicting the removal of some of the projections.

Additionally it is possible to slice a surface to form projections 34*e* as shown in FIGS. 23 through 24, where the material is cut as at 48 at intervals and additional cuts or slices 48*a* are made at an angle such as 90 degrees to the original cut to form a field 36 of projections 34*e*. Removed projections forming stubble 46*e* are shown.

In summary, an article 30 is formed having a field 36 of projections 34. The projections 34 are then selectively removed to form an indicium 38. The indicium 38 may be composed entirely of the removed projection 34 or, alternatively, projections 34 may be bordered by stubble 41 which serve to outline the indicium 38. Thus, in the first instance where the projections 34 have a colored core 40 different from the color of the cover 42, the indicium 38 will appear to have the color of the core 40. In this second instance, where the border for the indicium 38 is formed by the removal of projections 34, the border or field 32 will appear to have the color of the core 40 of the projections 34 and the indicium will be the color of the covering 42.

The selective removal of the projections 34 may be accomplished utilizing any suitable tool. Generally, the suitable tool will be a cutting, abrading or burning tool. In the case of soft materials such as elastomeric materials, such as found in an automobile tire or mat, nail clippers, scissors, pocket knives or abrading tools may be used. The removal of the proper projection may be facilitated by placing a template over the projections. Also convenient would be using a strip of thin flexible material such as metal foil or paper which can be placed between the projections 34 to outline the desired indicium 38 prior to the removal of the projections 36.

I claim:

1. In an article upon which a wide variety of designs may be made:

a surface comprising a grid-like field of closely arranged discrete projections;

each projection having a plurality of layers each of a different color; and said projections being selectively removable at any desired locations within the field to create a pattern of different color cross-sections collectively exhibiting the desired design.

2. The article of claim 1, wherein said layers of each projection comprise a covering of one color and a core of at least one other color.

3. The article of claim 2 wherein the core of the projection comprises colored strata selectively revealed by the removal of the projection.

4. The method of forming an identifying design after quality control inspection on the article of claim 2, comprising the steps of 1. selecting projections in the field of projections on the article of claim 2 that need to be removed to form a particular design; and
2. removing the selected projections to form the design.

5. The invention of claim 1 wherein said layers include one or more layers arranged at specific depths within the projections.

6. The invention defined by claim 5 wherein said different color layers extend throughout the field with specific colors at specific depths within the projections.

7. The invention defined by claim 5 wherein a specific color layer extends throughout one portion of the field and a specifically different color layer at the same depth extends throughout another portion of the field.

8. The invention defined by claim 1 wherein one color layer is at the free end of the projections and another color layer is beneath the layer at the free end.

9. The invention defined by claim 1 wherein one layer covers the free end and sides of the projections and another layer extends beneath the first mentioned layer.

10. The invention of claim 9 wherein the second mentioned layer is of a different color in one portion of the field than in another portion of the field.

11. The invention of claim 1 wherein one layer covers the free end and sides of the projections and a plurality of layers each of a different color at specific depths of the projections underlies the first mentioned layer.

12. The invention of claim 1 wherein said projections are arranged in determined rows and columns.

13. The invention defined by any one of claims 1 or 5–12 wherein at least one of the layers is composed of material which is an integral part of the material of which the article is formed.

14. The invention defined by any one of claims 1 or 5–12 inclusive, wherein each projection includes a core portion which is an integral extension of the material of which the article is formed and said core comprises one of said layers, and another layer comprises a cover overlying the core.

15. A method of forming a design on an article having a surface exhibiting a grid-like field of closely arranged discrete projections and wherein each projection has a plurality of layers each of a different color comprising the steps of:

selecting those projections within the field that can outline the desired design; and removing at least a portion of each of the selected projections to expose a layer of contrasting color in the cross-sections of such selected projections to create collectively the desired design.

16. The method of claim 15 wherein the projections are selectively removed by cutting.

17. The method of claim 15 wherein the projections are selectively removed by abrading.

18. The method of claim 15 wherein the projections are selectively removed by burning with a laser.

19. An article upon which a design has been incorporated, comprising:

on a surface of the article a grid-like field of closely arranged discrete projections;

each projection having a plurality of layers each of a different color; and a design in the field of projections formed by removing selected projections at desired locations, thereby exposing a pattern of different color cross-sections collectively exhibiting the desired design.

* * * * *